US008671865B2

(12) United States Patent
Valø

(10) Patent No.: US 8,671,865 B2
(45) Date of Patent: Mar. 18, 2014

(54) BRIDLE LINE CONTROL WINCH FOR A DEFLECTOR

(75) Inventor: Robert Valø, Fosnavåg (NO)

(73) Assignee: Ulmatec Baro AS, Fosnavag (NO)

( * ) Notice: Subject to any disclaimer, the term of this patent is extended or adjusted under 35 U.S.C. 154(b) by 236 days.

(21) Appl. No.: 13/233,660

(22) Filed: Sep. 15, 2011

(65) Prior Publication Data

US 2012/0067265 A1 Mar. 22, 2012

Related U.S. Application Data

(60) Provisional application No. 61/383,861, filed on Sep. 17, 2010.

(51) Int. Cl.
*B63B 21/56* (2006.01)

(52) U.S. Cl.
USPC ..... 114/244; 242/579

(58) Field of Classification Search
USPC ..... 242/164, 579, 407, 376, 587.1, 587.2; 254/374, DIG. 14, 390, 417, 371–373, 254/278, 283, 333, 334; 114/253, 254, 244, 114/245
See application file for complete search history.

(56) References Cited

U.S. PATENT DOCUMENTS

| | | | | |
|---|---|---|---|---|
| 4,574,723 | A | 3/1986 | Chiles et al. | |
| 5,346,153 | A * | 9/1994 | Ebey | 242/579 |
| 6,681,710 | B2 | 1/2004 | Semb | |
| 7,404,370 | B2 * | 7/2008 | Stokkeland | 114/253 |
| 7,658,161 | B2 | 2/2010 | Toennessen et al. | |
| 2009/0050044 | A1 | 2/2009 | Stokkeland et al. | |

FOREIGN PATENT DOCUMENTS

| | | | |
|---|---|---|---|
| EP | 0 168 959 | A1 | 1/1986 |
| GB | 2 266 285 | A | 10/1993 |

* cited by examiner

*Primary Examiner* — Edwin Swinehart
(74) *Attorney, Agent, or Firm* — Birch, Stewart, Kolasch & Birch, LLP

(57) ABSTRACT

A bridle line control winch for a deflector for marine towing, with fore and aft double or triple bridle lines to attachment points in upper, possible middle, and lower parts of the deflector, preferably in horizontal plate frames, wherein at least said fore or aft bridle lines are arranged to be adjusted inwardly and outwardly so as for adjusting an attack angle of said deflector relative to a course line. The bridle line control winch is provided with a pivotally arranged control winch frame arranged between said bridle lines' attachment points to the deflector, and the bridle lines themselves. The control winch frame is provided with a winch sheave with an asymmetrically arranged pulley arranged on said winch sheave for holding an eyelet or end of said bridle line. The winch sheave is arranged to be driven by an actuator in a desired direction of rotation.

10 Claims, 5 Drawing Sheets

BRIDLE LINE CONTROL WINCH FOR A DEFLECTOR

CROSS REFERENCE TO RELATED APPLICATIONS

Figure 1:
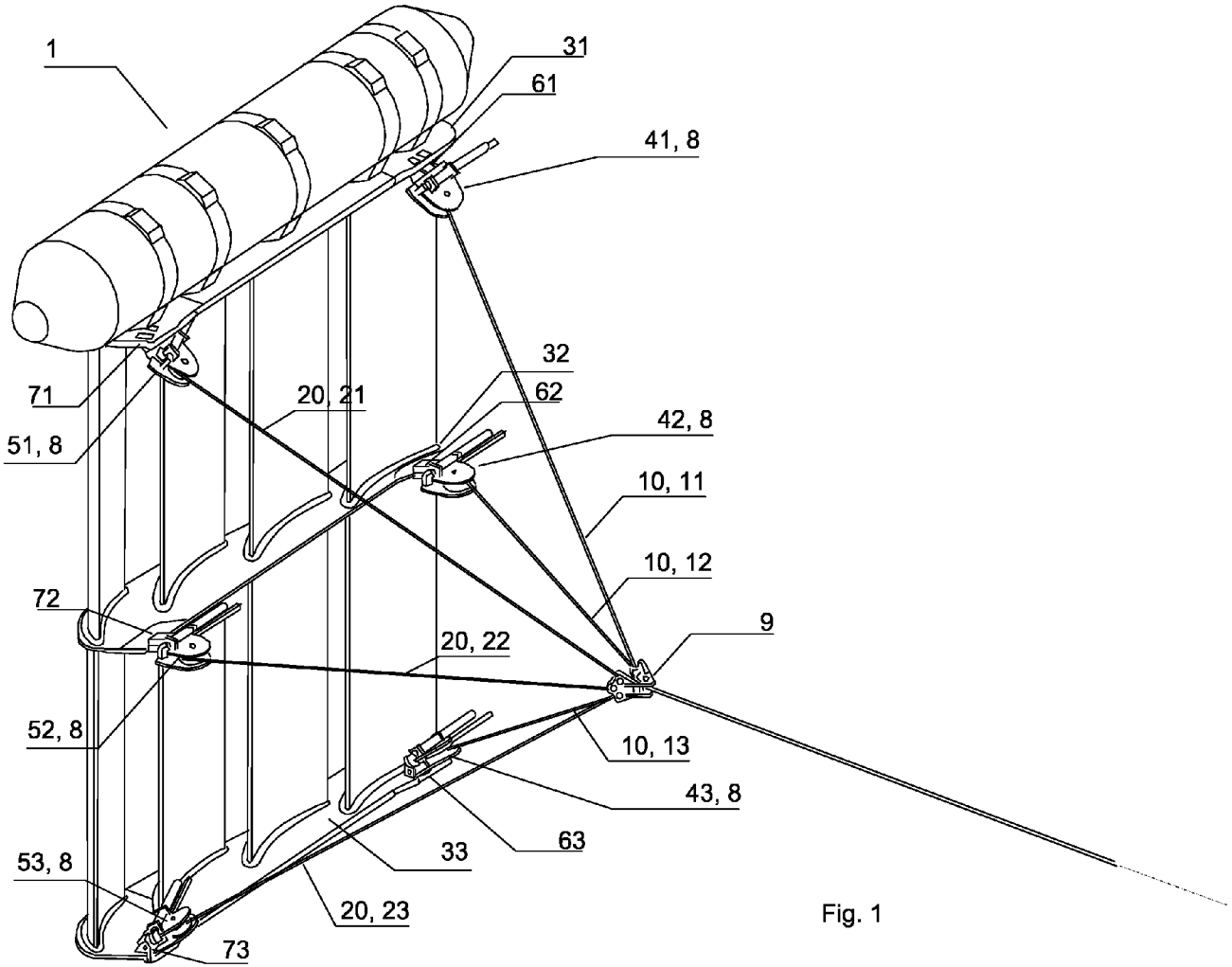

This nonprovisional application claims the benefit of U.S. Provisional Application No. 61/383,861 filed on Sep. 17, 2010. The entire contents of the above application is hereby incorporated by reference.

INTRODUCTION

Marine seismic surveys are usually conducted using a seismic vessel towing seismic sources and several parallel streamer cables with hydrophones. The parallel streamer cables are usually towed along straight lines over the prospective geological formation. The streamer cables are spanned by port and starboard deflectors which are also towed by the ship. In order to cover the desired geographical area the parallel seismic cables should be towed several times along parallel, reversely directed course lines. It is rational to turn at the end of each course line and make the next course line on the opposite course. An "unadjusted" turn at the end of a course line with unadjusted deflectors will, for the outer deflector in the turn incur an increased load strain on the towing line, bridle block, bridle line and the attachment points of the deflector, and the deflector itself. The inner deflector would require a certain speed in order to tighten the lines to a desired degree, and a deflector having a fixed position may provide a too small tensile force.

It is common practice to pre-adjust the angle of attack of the deflector manually by setting the lengths of the bridle lines or adjusting their attachment points on the bridle block inwardly or outwardly manually, before the deflector is launched to the sea. However, such a manually adjusted bridle line length does not allow any adjustment of the deflector's steering capacity before, during and after the turning operation: the deflectors' setting is fixed.

BACKGROUND ART

US2009/0050044 A1 shows a bridle block for a seismic deflector. The three forward and the three aft bridle-lines run into each end of a pitch chain that runs over a motorized cogged wheel which is arranged to relocate the point of attack of towing line on the pitch chain. Thus, the angle of attack of the seismic deflector may be adjusted inwardly or outwardly. A disadvantage of this U.S. application is that it does not necessarily run back to any default position if the motor for the cogged wheel should fail. It also has the weakness that it requires energy supply from the vessel through the towing line or from the deflector via a bridle line. Power supply through cables that are mainly towed mainly across the course line may be vulnerable and increases the diameter of the towing line or one of the bridle-lines.

U.S. Pat. No. 7,658,161 Tønnesen, Western Geco: System for depth control of a marine deflector, shows in FIG. 8B a deflector with fore and aft triples of bridle lines to the upper, middle and lower horizontal plate frame. It is stated in the description that each and all lines may be adjusted inwards and outwards so as for the tilt angle relative to the vertical may be adjusted to control both the depth and angle of attack relative to the course line in the horizontal plane may be adjusted. Tønnesen roughly outlines a number of different possible actuators which have little support with regard to mechanical design, and which have different mechanical weaknesses in the illustrated solutions.

U.S. Pat. No. 4,574,723 describes a deflector with a mechanism wherein the two lowest bridle lines may be slacked out in order for the deflector to lie flat on the sea, making it easier to haul in. It may thus vary the angle of tilt relative to vertical line on a rather extreme way.

EP0168959 Texas Instruments, describes an air gun deflector, a so-called "paravane" that has a longitudinally directed pitch rack which forms a joint for the paravane ends in order to control the fore and aft bridle lines simultaneously. It seems, however, unsuitable for retrofitting because the attachment points on the paravane are not directly prepared for the retrofitting, but wherein a retrofitting of various pulleys and connectors on the paravane is required.

GB2266285 British Aerospace ltd. shows a wild idea of an explosive bomb towed behind an airplane, wherein the bomb may be controlled in a manner similar to a paravane. The bomb is provided with three bridle lines (3*a*, 3*b*, 3*c*) that may be controlled by means of bridle line control winches (8). These do not anticipate the novelty of the actual mechanism presented in the present invention.

U.S. Pat. No. 7,658,161 Tønnesen shows a mechanism for depth control of a deflector.

SHORT SUMMARY OF THE INVENTION

The present invention is a bridle line control winch for a deflector for marine towing, with fore and aft bridle lines to connecting points in at least upper and lower parts of said deflector, wherein at least said fore or aft bridle lines are arranged to be adjusted inwardly and outwardly so as for adjusting an attack angle of said deflector relative to a course line, the novel features of the invention being that

- said bridle line control winch is provided with a pivotally arranged control winch frame arranged between said bridle lines' attachment points to said deflector, and said bridle lines themselves,
- said control winch frame is provided with a winch sheave with an asymmetrically arranged pulley arranged on said winch sheave for holding an eyelet or end of said bridle line, and
- wherein said winch sheave is arranged to be driven by an actuator in a desired direction of rotation.

Further embodiments of the invention are specified in the attached dependent claims.

In another aspect of the invention it is a deflector (1) for marine towing with at least pairs of fore and aft bridle lines (10, 20) from a bridle block (9) to attachment points (61, 63, 71, 73) at least at upper and lower parts of said deflector (1), to horizontal plate frames (31, 33) wherein at least said fore (11, 13) or said aft bridle lines 21, 23) are arranged to be adjusted inwardly and outwardly so as for adjusting an angle of attack of said reflector (1) relative to a course line. The novel features of the invention are

- bridle line control winches (41, 43, 51, 53), each with a pivotally arranged control winch frame (8) arranged between said bridle lines (11, 13, 21, 23) and said attachment points (61, 63, 71, 73) on said deflector and said bridle lines themselves,
- wherein said control winch frame (8) is provided with a winch sheave (81) with an asymmetrically arranged eyelet (82) arranged on said winch sheave (81) for holding an eyelet or end (15) of said bridle line (11, 13, 21, 23), and, wherein said winch sheave (81) is provided with a gear rim (84) driven by an actuator (83) in a desired direction of rotation.

Expressed in a simpler way, the present invention is a bridle line control winch arranged to receive a deflector-connecting eyelet on an eccentrically arranged pulley on a small winch pulley provided with gear rim driven by a pitch rack which again is driven by a hydraulic piston. The main frame of the bridle line control winch is provided with a pair of eyelet plates (89) arranged to be connected to the corresponding horizontal axial hinges that constitute attachment points on the upper, middle and lower main frames, respectively, on the deflector. One detail is, that if there are upper, middle and lower bridle lines (21, 22, 23), one will realize that the upper and lower bridle line control winches (41, 43, 51, 53) have to run further during tightening and slacking of bridle lines (11, 13, 31, 23) than the middle bridle line control winch (42, 52) during tightening and slacking of the middle bridle lines (12, 22) in order to maintain a even tension on all bridle lines.

Advantages of the Invention

Easier to Turn the Towed Seismic Array

Figure 4:
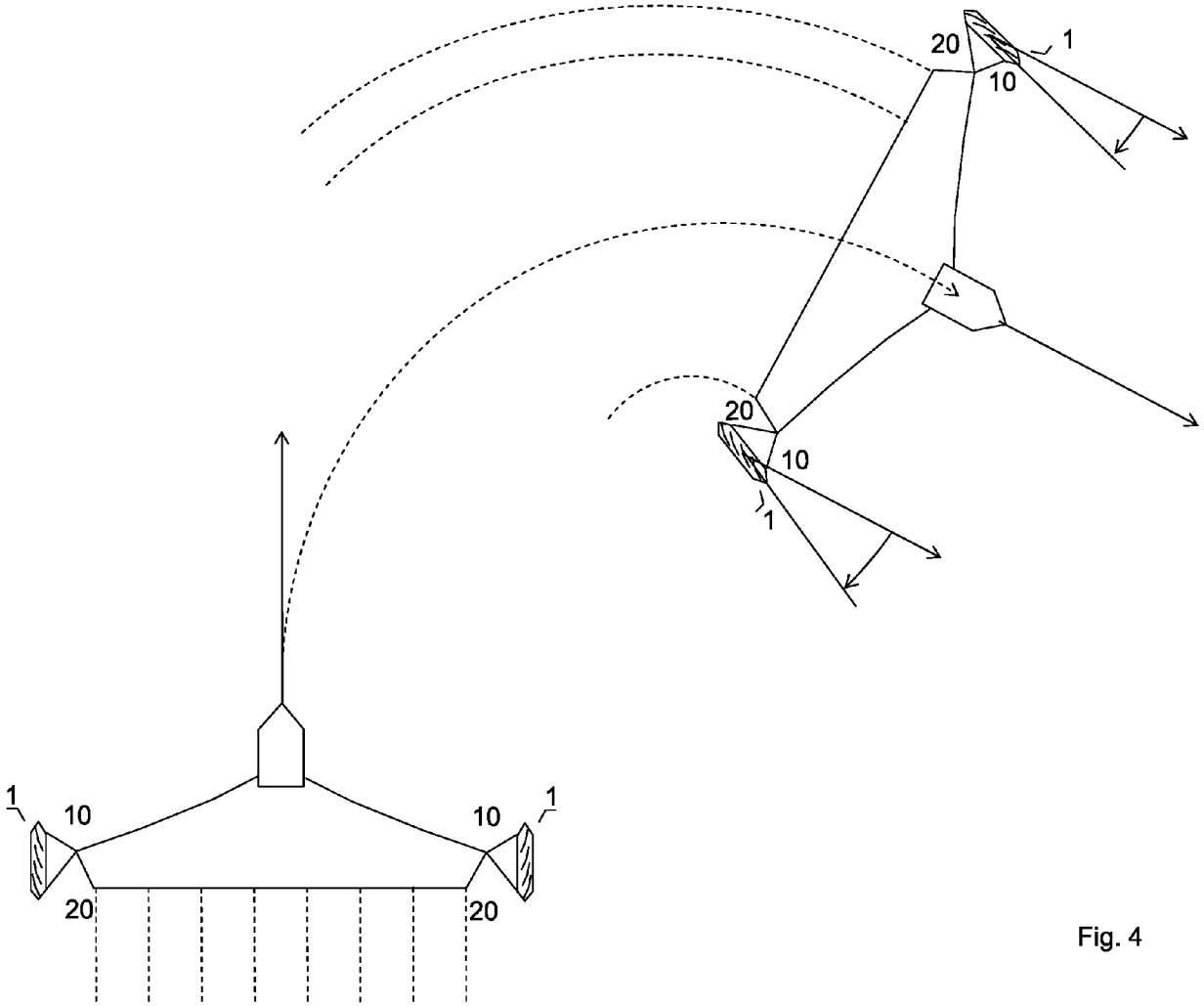

During turning a seismic towed array as illustrated in FIG. 4 with the bridle line control winches according to the invention in order to "return" to continue the seismic survey along a parallel course, it is advantageous that the outer and inner deflector in tow may be steered, much like front wheels of a car, so that the outer deflector will turn more easily, and also for the inner deflector to keep an appropriate course and that both should have appropriate tension in the lines and cables. This may make the turning operation to be conducted faster and consuming less fuel.

Easier to Control the Seismic Tow for Small Deviations from the Course Line

Correspondingly, it is also easier to control the towed seismic array because under a varying heading of the seismic vessel, please see e.g. U.S. Pat. No. 6,681,710B2 FIG. 2, one usually requires that one gives out and hauls in on the starboard and port sides' deflector line winches, respectively, on the seismic vessel. By means of the invention, one may rather increase or decrease the angle of attack of the tow lines when the seismic vessel has to adjust the course along the desired course of the towed seismic array. It is important to note that the bridle line control winch according to the invention does not change more than a few decimeters on the front and aft bridle line and thereby controls the angle of attack of the deflector which leads to changes in angle of attack of the tow line, thereby adjusting for minor deviations in the vessel's course so that the towed seismic array adjusts the course line. This is in contrast to U.S. Pat. No. 6,681,710 which adjusts the length of the tow line itself.

Default Position

One of the advantages of the present invention is, that if the hydraulic pressure is lost, it runs back to a default position with the bridle line unwound completely from the winch and hanging at the pulley. In such position the deflector will operate as intended while running at straight course.

Storage Along the Hull Side

The feature that bridle line control winch frame according to the invention is hinged onto the main deflector frame allows that during lifting out of the sea for the storage of the deflector (which may have up to 10 m high wings and pontoon of 10 m length) on the hull side, they will tilt down from their working positions (see FIG. 1) tensioned by the bridle-line, and down to a generally vertical position that is not in conflict with the skin plates of the hull side.

Use of Existing Attachment Lugs for the Bridle Lines on the Main Frames of the Deflector The bridle-line control winch according to the invention has a pulley on the winch sheave that corresponds to such a pulley onto which the eyelet of the bridle-line usually is attached, thus the frame of the control winch frame may be retrofit in the existing attachment lugs on the main frame of the deflector, so that the bridle line control winch of the invention may be retrofit between standard bridle-lines and existing deflectors.

The Mounting Close to the Deflector Simplifies Power Supply to the Actuator

A further advantage of the invention is that even though the actuators of the bridle line control winches require power supplied from the deflector, this power supply, in this case a hydraulic hose, will not have to run via the bridle lines, and it all becomes less vulnerable, one gets short hydraulic transmission lines and does not need to increase the diameter of some of any of the bridle lines.

Mechanical Robustness

The system according to the present invention is simple and robust compared to the more exposed mechanisms and line-guides of the prior art.

SHORT FIGURE CAPTIONS

The invention is shown in the attached figures, wherein

FIG. 1 shows a deflector for seismic towing with a bridle line control winch according to the invention arranged in the upper aft attachment point for a bridle-line. Attachment lugs for the corresponding upper and middle fore bridle liner are also illustrated.

Figure 2:
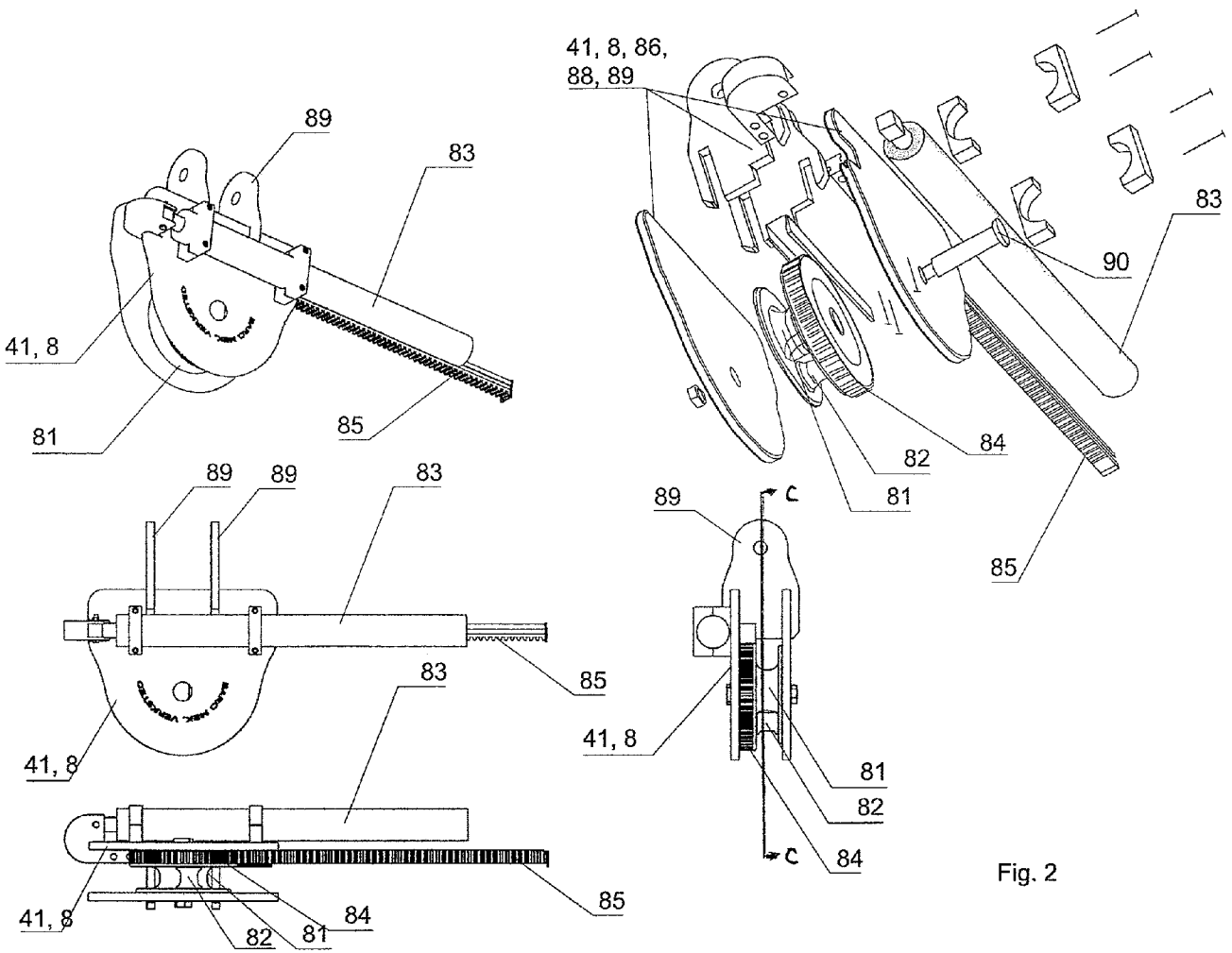

FIG. 2 shows isometric and orthogonal views of an embodiment of the bridle line control winch according to the invention, with a hydraulic linear actuator provided with a pitch rack that drives a cogged wheel between the plates of the winch frame, which in turn drives the main pulley of the winch some few turns for tightening or slacking of the end of a bridle line. The bridle line control winch with pitch rack actuator is also shown in an exploded isometric view.

Figure 3:
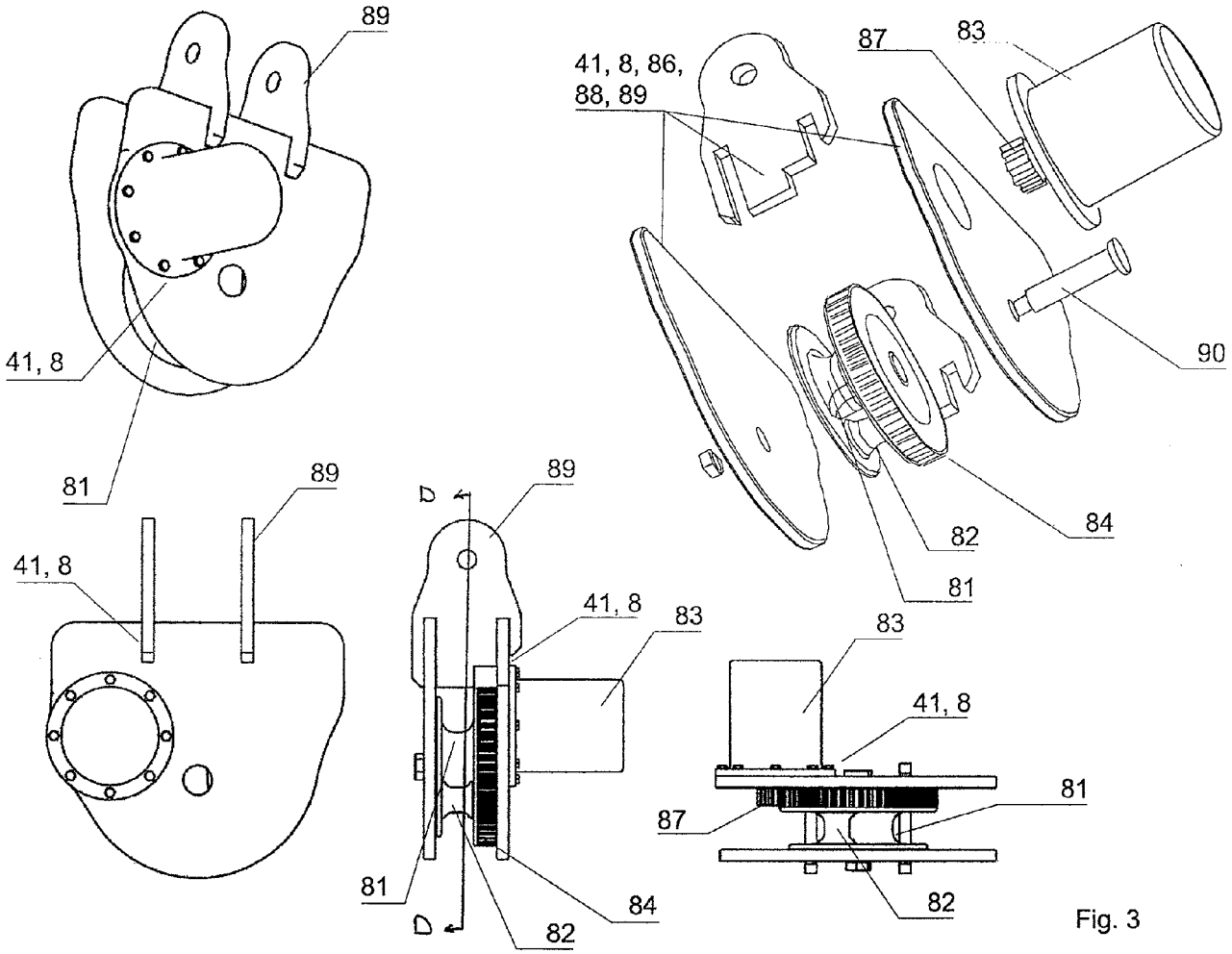

FIG. 3 shows, in similar views, an alternative embodiment of the bridle line control winch according to the invention with a rotary engine actuator with a shaft provided with a small gear wheel that drives a cogged wheel between plates of the winch frame, which in turn drives the winch main pulley of the winch in the same manner as mentioned above, a few turns for tightening or slacking of the end of a bridle line. The bridle line control winch rotary motor actuator is also shown in an isometric exploded view drawing.

FIG. 4 shows a simplified map view of a seismic survey vessel at sea, where the seismic vessel tows a seismic array of streamer cables spanned out by the deflectors at the starboard and port sides. In the upper right part of the drawing the seismic deflectors are turned more towards the starboard than the vessel itself in order for the inner deflector to make a sharper turn than the vessel, and the outer deflector is rotated more towards starboard than the vessel to avoid the outer deflector be put under too much tension.

Figure 5:
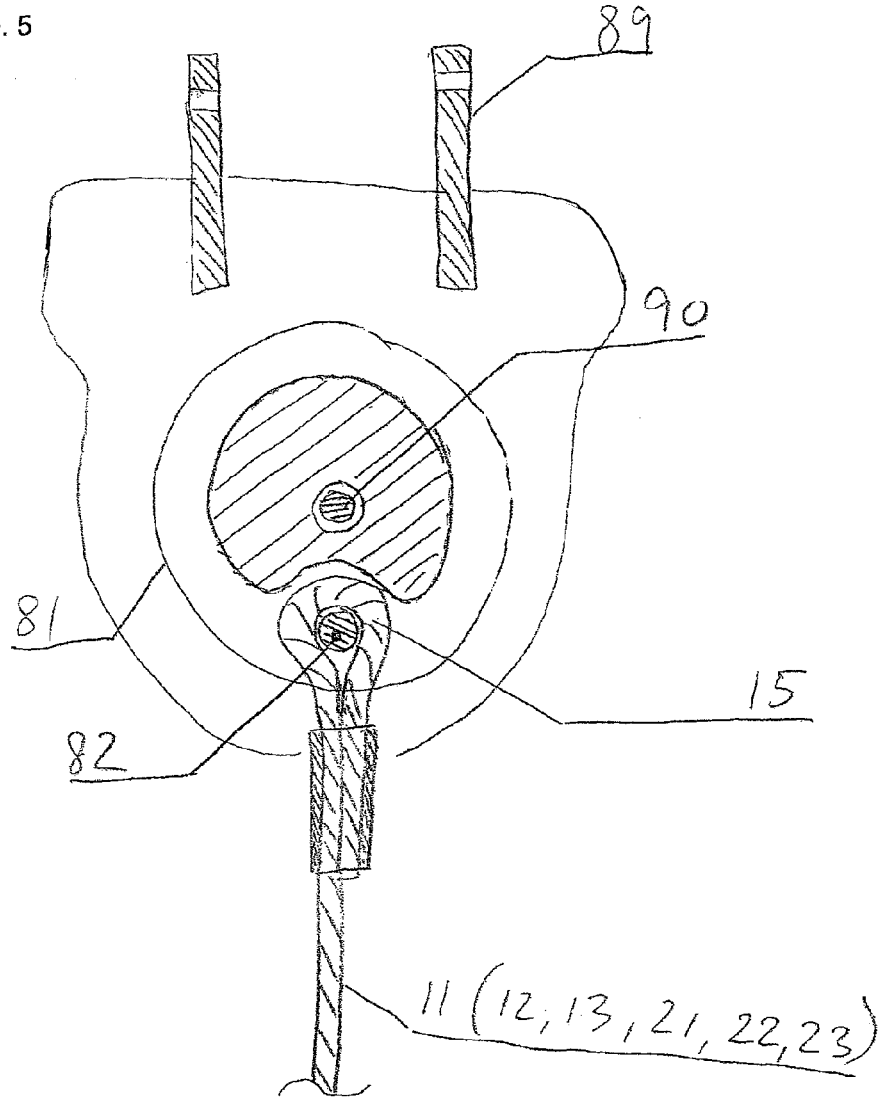

FIG. 5 is a cross-sectional view of the bridle control line winch taken along line C-C of FIG. 2 and along line D-D of FIG. 3.

DESCRIPTION OF AN EMBODIMENT OF THE INVENTION

The present invention is related to a bridle line control winch (41, 42, 43, 51, 52, 53) for a deflector (1) for towed marine arrays. The deflector (1) is provided with fore (10) and aft (20) double or triple bridle lines (11, 12, 13, 21, 22, 23) to attachment points (61, 62, 63, 71, 72, 73) in the upper, middle, and lower parts of the deflector (1). The opposite ends of the bridle lines are attached to a so-called bridle block (9) that forms a transition towards the tow line. Usually the attachment points for bridle lines of the deflector are arranged in the horizontal plate frames (31, 32, 33). The plate frames form a mechanical structure in order to hold the vertical deflector wings in place and in proper position. The fore (11, 12, 13) or aft bridle lines (21, 22, 23) according to the invention are arranged to be adjusted inwardly and outwardly by means of bridle line control winches so as for the angle of attack of the deflector (1) relative to a course line to be adjusted.

The bridle control winch (41, 42, 43, 51, 52, 53) is provided with a pivotally arranged control winch frame (8) arranged between the attachment points (61, 62, 63, 71, 72, 73) of the bridle lines (11, 12, 13, 21, 22, 23) and attachment points on said deflector and the bridle lines themselves. The bridle lines are tightened and turns the bridle line control winches to their operative position as shown in FIG. 1.

Each control winch frame (8) is provided with a winch sheave (81) with an asymmetrically arranged eyelet pulley (82) arranged on said winch sheave (81), see FIG. 2. The eyelet pulley (82) is arranged to hold an eyelet or end (15) of said bridle line (11, 12, 13, 21, 22, 23), as best seen in FIG. 5. The winch sheave (81) is provided with a gear rim (84) driven by an actuator (83) in a desired direction of rotation.

In an embodiment of the invention as illustrated in FIG. 2 the actuator (83) is a hydraulic cylinder which drives a pitch rack (85) which in turn drives a gear rim (84) on said winch sheave (81). If the hydraulic pressure should drop, the bridle line will pull the winch sheave (81) to a neutral position i.e. unwind the bridle line until the eyelet hangs on the pulley (82).

In an another embodiment of the invention as illustrated in FIG. 3 the actuator (83) is a rotary motor with a shaft provided with a gear wheel (87) which drives a gear rim (84) on said winch plate (81). Otherwise the bridle line control winch is similar to the embodiment shown in FIG. 2. The motor is in a preferred embodiment a hydraulic motor. The hydraulics of the actuators (83) may be pressurized by a pressure generator on board the deflector's (1) floating body in the usual way.

The actuators may be provided with control devices known as such, in order to be steered from the seismic vessel, and it is a task for the person skilled in the art to design such control devices. The control devices control the hydraulic pressure to the actuators (83) to give the desired length of each single bridle line so as for setting the desired angle of attack relative to the course line.

In both FIGS. 2 and 3 are shown control winch frames (8) built up by two steel plates (86, 88) respectively, arranged at the sides of the winch sheave (81) and the gear rim (84) so as for enveloping them and wherein said winch sheave and gear rim (81, 83) are arranged on a common shaft (90). The two steel plates (86, 88) are connected by two lug plates (89) with holes for a hinge shaft for pivotal attachment to the attachment points (61, 62, 63, 71, 72, 73) on the deflector. The hinge shaft is arranged orthogonal to the shaft (90). The hinge shaft is also arranged in the plane of the winch sheave (81). In this way the bridle line control winches may hang straight down from their attachment points when the bridle lines are slack, and turn to their operative positions when bridle lines are tightened.

The invention claimed is:

1. A bridle line control winch system for a deflector for marine towing, comprising fore and aft bridle line winches for fore and aft bridle lines, said bridle line winches attached to connecting points in upper fore and aft, middle fore and aft and lower fore and aft parts of said deflector, wherein at least said fore and aft bridle lines are arranged to be adjusted inwardly and outwardly so as for adjusting an attack angle of said deflector relative to a course line, each of said bridle line control winches is provided with a control winch frame pivotally attached to said connecting points of said deflector, each of said control winch frames is provided with a winch sheave with an asymmetrically arranged pulley arranged on said winch sheave for holding an eyelet or end of one of each corresponding said bridle lines, and wherein said winch sheave is arranged to be driven by an actuator in a desired direction of rotation.

2. The bridle line control winch system according to claim 1, wherein said winch sheave is provided with a gear rim arranged to be rotated by a cogged device on said actuator.

3. The bridle line control winch system according to claim 2, wherein said actuator is a hydraulic cylinder which drives a pitch rack which in turn drives said gear rim on said winch sheave.

4. The bridle line control winch system according to claim 2, wherein said actuator is a rotary motor with a shaft with a gear wheel which drives said gear rim of said winch sheave.

5. The bridle line control winch system according to 1, wherein said connecting points are arranged at least at upper and lower horizontal plate frames in corresponding upper and lower parts of said deflector.

6. The bridle line control winch system of claim 2, wherein said connecting points are arranged at least at upper and lower horizontal plate frames in corresponding upper and lower parts of said deflector.

7. The bridle line control winch system of claim 3, wherein said connecting points are arranged at least at upper and lower horizontal plate frames in corresponding upper and lower parts of said deflector.

8. The bridle line control winch system of claim 4, wherein said connecting points are arranged at least at upper and lower horizontal plate frames in corresponding upper and lower parts of said deflector.

9. The bridle line control winch system according to claim 2, wherein said fore or aft bridle line control winches are arranged to operate in unison.

10. The bridle line control winch system according to claim 2, wherein said fore and aft bridle lines control winches are arranged to operate in unison.

* * * * *